US005560947A

United States Patent [19]

Bell

[11] Patent Number: 5,560,947

[45] Date of Patent: Oct. 1, 1996

[54] SEALED PACKAGE CONTAINING RESPIRING PERISHABLE PRODUCE

[75] Inventor: Laurence D. Bell, Carmel Valley, Calif.

[73] Assignee: Transfresh Corporation, Salinas, Calif.

[21] Appl. No.: 430,123

[22] Filed: Apr. 25, 1995

Related U.S. Application Data

[63] Continuation of Ser. No. 79,537, Jun. 17, 1993, abandoned, which is a continuation of Ser. No. 837,572, Feb. 18, 1992, abandoned, which is a continuation of Ser. No. 596,685, Oct. 12, 1990, abandoned, which is a division of Ser. No. 238,962, Aug. 26, 1988, Pat. No. 4,996,071, which is a continuation of Ser. No. 43,427, Apr. 28, 1987, abandoned.

[51] Int. Cl.[6] ..... B65B 25/02; B65D 30/02

[52] U.S. Cl. ..... 426/106

[58] Field of Search ..... 426/415, 419, 426/410, 418, 106, 413

[56] References Cited

U.S. PATENT DOCUMENTS

| | | | |
|---|---|---|---|
| 2,452,174 | 10/1948 | Arnold | 426/419 |
| 2,611,709 | 9/1952 | Plagge | 426/419 |
| 3,102,777 | 9/1963 | Bedrosian | 426/419 |
| 3,423,212 | 1/1969 | Purcell et al. | 426/415 |
| 3,450,542 | 6/1969 | Badran | 426/419 |
| 3,450,543 | 6/1969 | Badran et al. | 426/415 |
| 3,450,544 | 6/1969 | Badran et al. | 426/415 |
| 3,507,667 | 4/1970 | Magnen | 426/419 |
| 3,630,759 | 12/1971 | Rumberger | 426/415 |
| 3,795,749 | 3/1974 | Cummin et al. | 426/415 |
| 3,798,333 | 3/1974 | Cummin et al. | 426/415 |
| 3,804,961 | 4/1974 | Cummin et al. | 426/415 |
| 4,079,152 | 3/1978 | Bedrosian et al. | 426/415 |
| 4,224,347 | 9/1980 | Woodruff | 426/419 |
| 4,423,080 | 12/1983 | Bedrosian et al. | 426/415 |
| 4,515,266 | 5/1985 | Myers | 426/419 |
| 4,711,789 | 12/1987 | Orr et al. | 426/419 |

FOREIGN PATENT DOCUMENTS

| | | | |
|---|---|---|---|
| 178218 | 4/1986 | European Pat. Off. | 426/106 |
| 2033541 | 12/1970 | France | 426/419 |
| 2531042 | 2/1984 | France | 426/118 |
| 47-17187 | 5/1972 | Japan | 426/419 |
| 53-8781 | 3/1978 | Japan | 426/415 |

OTHER PUBLICATIONS

Modern Packaging Jun. 1948 p. 163 plus.

Packaging Engineering Aug. 1974 p. 51.

Csiro Food Res. Q. 44(2), 25–33, 1984.

Modern Packaging, 40, #2, 1966.

Revue Generale Du Froid Na3 Mar. 1974 p. 217 plus.

Food Processing Jan. 1985 p. 152 plus.

Refrigeration Science and Technology p. 149 plus Int'l Inst. of Refrig. 1973.

Packaging, Japan Nov. 1985, p. 17 plus.

Proceedings of Int'l Conf. on Controlled Atm Packaging Oct. 1984 Rizvi p. 135 plus.

*Primary Examiner*—Steven Weinstein

[57] ABSTRACT

A method for determining and controlling the proper modified or unmodified atmosphere packaging for cut or uncut respiring perishables such as cauliflower, lettuce and broccoli includes the steps of determining the respiration rate of the respiring perishable, preparing a plurality of packages containing the respiring perishable with each package having a different permeant factor, determining a value called atmosphere quotient for each of the packages according to this formula: atmosphere quotient equals permeant factor divided by respiration rate; subjecting each of the packages to known conditions of temperature and pressure over a known period of time and correlating the subjective and objective indicia of quality, appearance and marketability of the respiring perishable from each package to the atmosphere quotient values determined according to the foregoing formula, and then varying one or more of the values of the components that affect permeant factor to achieve and maintain the optimum value or range of values for atmosphere quotient.

7 Claims, No Drawings

SEALED PACKAGE CONTAINING RESPIRING PERISHABLE PRODUCE

This application is a continuation of pending prior Application Ser. No. 08/079,537 filed Jun. 17, 1993, now abandoned, which is a continuation of application Ser. No. 07/837,572 filed Feb. 18, 1992, now abandoned, which is a continuation of Application Ser. No. 07/596,685 filed Oct. 12, 1990, now abandoned, which is a division of Application Ser. No. 07/238,962 filed Aug. 26, 1988, now U.S. Pat. No. 4,996,671, which is a continuation of Application Ser. No. 07/043,427 filed Apr. 28, 1987, now abandoned, entitled "METHOD OF PACKAGING PERISHABLES" by Laurence D. Bell.

This invention relates to a method for determining proper modified or unmodified atmosphere packaging for cut or uncut respiring perishables such as cauliflower, lettuce and broccoli.

The methods of this invention comprise the following steps:

(1) determining the respiration rate (R) of a respiring perishable such as cauliflower, broccoli or lettuce;

(2) preparing a plurality of packages containing the respiring perishable with each package having a different permeant factor (G), where the permanent factor (G) is equal to: the area (A) of packaging material, e.g., a film, required to enclose a given weight of the respiring perishable in a modified or unmodified atmosphere, multiplied by the permeability (P) of the packaging material to one of the gases of respiration, such as oxygen or carbon dioxide, and divided by the weight (W) of the perishable to be enclosed in the packaging material;

(3) for each of the packages prepared in step (2) above, determining a value called atmosphere quotient (AQ) in accordance with the following formula: Atmosphere quotient (AQ) equals permeant factor (G), from step (2) above, divided by the respiration rate (R) of the perishable from step (1) above;

(4)subjecting each of the packages containing respiring perishable to known temperatures and pressures over a known, preferably predetermined period of time, and correlating the subjective and objective indicia of quality, appearance and marketability of the respiring perishable from each of the packages to the atmosphere quotient values determined in step (3) above; and (5) varying one or more of the values of the components (A), (P) and/or (W) of permeant factor (G) to achieve and maintain the optimum value or range of values for atmosphere quotient determined in step (4) above. Once atmosphere quotient has been determined by these methods, the values of the components (A), (P) and/or (W) that correspond to the optimum atmosphere quotient value or values can be further varied as desired.

In preferred embodiments, the methods of this invention may also include the step of determining the oxygen and carbon dioxide quotients independent of one another so that the ratio of carbon dioxide-to-oxygen permeabilities for a given package of a perishable can be optimized. The ratio of carbon dioxide-to-oxygen permeabilities for a given package of a given perishable directly influences the equilibrium ratio of carbon dioxide-to-oxygen concentrations inside the package. At equilibrium, the amount of oxygen permeating into the package is substantially equal to the oxygen consumed by the perishable inside the package, and the amount of carbon dioxide permeating out of the package is substantially equal to the carbon dioxide produced inside the package. Thus, once an optimum carbon dioxide or oxygen quotient is determined as in step (4) above with a packaging material of a given carbon dioxide-to-oxygen permeability ratio, then changing to a material of different carbon dioxide-to-oxygen permeability ratio may require a new atmosphere quotient determination.

An atmosphere quotient value determined in accordance with these methods can differ, for a given respiring perishable in a given packaging material, with the initial void volume per unit weight of perishable within the package, the equilibrium void volume per unit weight of perishable within the package, or both. Accordingly, the new methods also require redetermining atmosphere quotient values if the initial or the equilibrium void volume within a given package changes.

In preferred embodiments, the permeability of the packaging film is measured in cubic centimeters of gas such as oxygen or carbon dioxide transmitted through 100 square inches of packaging for 24 hours at 72° F., and less than 50% relative humidity (RH). The area of film is preferably measured in 100 square inches, and the weight of packaged perishable in grams, kilograms or pounds.

In preferred embodiments, the method for determining the respiration rate of a perishable product such as cauliflower comprises the following steps:

(1) placing duplicate, equal weight samples of the perishable in dessicators that have been cooled to a known temperature above the freezing point of water and below 50° F., say 45° F.;

(2) sealing the dessicators, and connecting each dessicator to a continuous, controlled stream of filtered, humidified air, flowing at a nominal rate of about 40 milliliters per minute;

(3) maintaining the flow of filtered, saturated air to the dessicators for 24 hours while maintaining the dessicators at 45° F., and then collecting a small sample, say 10 milliliters, of the gases flowing from the dessicators;

(4) measuring the percent by volume of carbon dioxide or of oxygen in the gas flowing from the dessicators using gas chromatography precalibrated as necessary, or another analytical method;

(5) measuring the actual rate of air flow to the dessicators using, for example, the graduated cylinder/volume displacement method; and (6) repeating these same steps (2)–(6) after another 24 hours of storage 45° F., with gas flow to the dessicators maintained at a known flow rate, for example, 40 milliliters per minute. The respiration rate of the perishable in milligrams of carbon dioxide per kilogram-hours can then be calculated in accordance with the following formula: milligrams of carbon dioxide per kilogram-hour is equal to the volume of carbon dioxide in the gas outflow from a dessicator, measured in milliliters per minute, multipled by 60 minutes, divided by the sample weight of the perishable in a dessicator, measured in kilograms, and multipled by the factor 1.964 milligrams, where the factor 1.964 milligrams equals the gram weight of one milliliter of carbon dioxide, or $$\text{mg } CO_2\text{/kg-hr} = \frac{(\text{volume } CO_2 \text{ ml/min})\,(1.964 \text{ mg})\,(60 \text{ min})}{\text{weight of perishable in kilograms}}$$

The product respiration rates at the end of 24 hours and at the end of 48 hours are preferably averaged to determine the respiration rate of the perishable.

In preferred embodiments, the method for determining film permeability comprises the following steps:

(1) placing an 8 inch diameter sample of the packaging film, free of manufacturing defects and mechanical abrasions, between two 7-inch, 550 milliliter containers that are sealed to prevent inflow or outflow of gas, as by use of an O-ring and clamp;

(2) directing a flow of gas whose film permeability is to be tested, such as oxygen or carbon dioxide, into one of the two containers, through inlet and outlet valves, at a predetermined rate, say one liter per minute, while flushing the other container with nitrogen;

(3) maintaining gas flow to each container as in step (2) until one container contains 99% or more of the gas whose film permeability is to be tested, namely oxygen or carbon dioxide, and the other container contains 0.02% or less of the test gas;

(4) shutting off the valves and recording the time and temperature;

(5) waiting until sufficient test gas has diffused through the film into the second chamber to raise the concentration of the test gas in the second chamber to a value in the range of 1.5% to 2.5% by volume;

(6) extracting a small, say 10 milliliter gas sample from the second chamber and measuring the percentage of test gas in the sample as, for example, by gas chromatography, and recording the time and temperature of sample collection; and (7) calculating the gas transmission rate in terms of volume of gas diffusing through the film per unit area of the film within a specific time interval in accordance with the following formula: permeability equals volume of the second container multiplied by the area of the film and by the percentage of test gas found in the second container minus the amount of test gas in the second container before diffusion began and divided by the diffusion time and by the factor 100. The permeability so determined is expressed in units of cubic centimeters of gas per 100 square inches of film diffusing through it over a 24-hour period at 72° F. In mathematical terms, the formula is as follows:

$$\text{Permeability} = \frac{\text{(volume of second chamber)}\ \text{(net percent of permeant gas diffused)}\ \text{(area of film) (24 hours)}}{\text{(100) (diffusion time)}}$$

In preferred embodiments, the permeant factor can be adjusted or varied by changing film permeability, i.e., film thickness or film composition. The package dimensions can be varied by increasing or decreasing the surface area of packaging. The package weight can be varied by simply increasing or decreasing the weight of perishable enclosed within a given package.

In preferred embodiments, atmosphere quotient as a measure of marketability of a perishable is determined by assigning arbitrary atmosphere quotient values to a plurality of packaged samples of the perishable. Each package should be made of the same packaging material, have the same package area, the same internal void volume per unit weight of perishable in the package, and the same packaging material permeability. To achieve the assigned quotient values, such packages can have differing, known weights of perishable enclosed in them. Finally, the effect of such variations in atmosphere quotient upon marketability of the perishable are determined. In such determinations, flexible packaging material is preferably used, with the permeability and surface area of the package held constant to facilitate maintaining the internal void volume per unit weight packaged substantially the same for all samples.

Marketability can be evaluated by storing each of the packaged perishable samples at a given temperature, say, 45° F., for a period of time, say 20 days or more, but preferably not more than about 10 or 15 days, followed by subjective evaluations of each sample for freshness of appearance, taste and/or other sensory attributes indicative of marketability. Objective indices of marketability are derived from analyses of such variables as micro-biological content, pigmentation, carbohydrate content, and fermentation products such as ethanol and acetaldehyde. In this way, a first series of atmosphere quotient values that correlate with subjective and objective marketability indices of the perishable can be developed. For nearly all respiring perishables, the correlation between atmosphere quotient and marketability is curvilinear. Below and above the optimum values on this curve, marketability of the perishable declines. For each of the subjective and objective indicia, linear correlations, either positive or negative, with the atmosphere quotient values can be observed and plotted.

Thereafter, further series of such correlations can be obtained by varying the permeability of the packaging film while holding all other variables the same, or by varying the area of the package while holding all. other variables the same. From these series of tests, a range of atmosphere quotients that correlate most closely with marketability of the perishable can be developed.

Thereafter, the range of atmosphere quotient values so developed can be used to determine the corresponding range of permeant factor values in accordance with the formula Q equals G divided by R, where Q is atmosphere quotient, G is permeant factor, and R is the respiration rate of the perishable. Utilizing the range of permeant factors so determined, the area of the package, the permeability of the packaging film, and the weight of perishable packaged can be optimized by appropriate adjustments of one or more of these variables in accordance with the following formula: G equals AP divided by W, where G equals permeant factor; A is the area of the packaging film, preferably measured in 100 square inches; P is the permeability of the packaging film per 100 square inches of film; and W is the weight, measured in pounds, of perishable enclosed in the package.

Permeant factor should be adjusted to accommodate varying respiration rates between two or more batches of respiring perishable of the same kind to maintain the atmosphere quotient within the optimum range. Because respiration rate can vary widely from one batch of a given respiring perishable to another batch, the respiration rate should be measured for each new batch of perishable of the same kind. Batches can vary from one another in variety, source, maturity, or some combination of these. Moreover, the initial and the equilibrium void volume in each package per unit weight of perishable should be substantially the same regardless of package size and regardless of the weight of perishable within the package.

Where the nature of the packaging material precludes maintaining the initial or the equilibrium void volume per unit weight of perishable within each package substantially the same as the values determined without taking account of changes in these values, atmosphere quotient may need to be redetermined with each change in these values. These void volume problems arise most often with rigid packaging material. For example, as equilibrium void volume inside a rigid package increases, the quantity of oxygen and/or carbon dioxide enclosed in the package should also increase, and vice-versa. One way of obtaining this result is by varying the permeability of the packaging material. With flexible or rigid packages, the initial void volume in a package per unit weight of perishable can be held constant by adjusting the area of material in the package.

After determining the atmosphere quotient for a given perishable in a given package, and after redetermining atmosphere quotient, as necessary, to allow for changes in initial and equilibrium void volume, the benefits of atmosphere modification can be more easily determined. Where the initial void volume in a package is small, it may be necessary to add oxygen to the package before sealing to attain the desired initial oxygen concentration. Further, where the initial void volume in the package contains a gas other than air alone, allowances must be made for changes in internal void space resulting from respiration of the perishable in the package and from permeability of the packaging material. For example, most flexible packages will become smaller in direct proportion to the initial oxygen concentration in the initial void volume where a perishable inside the package consumes oxygen faster than oxygen enters the package by permeability or otherwise.

Thus, increases in initial oxygen concentration in flexible packages will cause decreases in equilibrium void space, and vice-versa.

EXAMPLE 1

Following the methods disclosed above, and using carbon dioxide to measure respiration rate, we determined that the optimum range of oxygen quotients for cauliflower was 19 to 38 where the initial void space in each cauliflower package was filled with 800 milliliters of air per pound of cauliflower.

We measured the respiration rate of cauliflower by the method described above, and determined that the respiration rate of cauliflower was 48 milligrams of carbon dioxide per kilogram per hour.

We measured the permeability of the packaging film by the method described above, and determined that the permeability to oxygen of the packaging material, namely 1.5 mil-thick, low-density polyethylene film including 12% by weight of ethylene vinyl acetate, was 550 cubic centimeters of oxygen per 100 square inches for 24 hours at 72° F., and a relative humidity of less than 50%.

We measured the area of each package for the cauliflower and determined the area to be 776 square inches or 7.76 times 100 square inches.

We then computed the weight of cauliflower to be enclosed in each package from this formula: W (weight to pack) equals AP (package area times package permeability) divided by G (permeant factor) with A equal to 7.76 (100 square inches), P equal to 550 (cc's of $CO_2$ per 100 square inches per 24 hours at 72° F., and less than 50% relative humidity, and AP equal to 1,268. For the four atmosphere quotient values of 21, 27, 33 and 38, we computed the permeant factor and the weight of cauliflower per package as shown in this table:

| Quotient | Permeant Factor (AQ × R) | Weight (W) to Pack (AP/G) |
|---|---|---|
| 21 | 1008 | 4.2 lbs. (a) |
| 27 | 1296 | 3.3 lbs. (b) |
| 33 | 1584 | 2.7 lbs. (c) |
| 38 | 1824 | 2.3 lbs. (d) |

After storing each of these sample packages (a), (b), (c) and (d) at 45° F. for 10 days, we evaluated each package for the percentage of marketable cauliflower in each package, and obtained the data shown in this table:

| Quotient | Average Marketability Score |
|---|---|
| 21 (a) | 18% |
| 27 (b) | 35% |
| 33 (c) | 36% |
| 38 (d) | 24% |

Based on the results shown in this table, we concluded that the oxygen atmosphere quotient range of 27 to 33 appeared most likely to optimize marketability of the cauliflower. By continuing our testing as set forth in this example, we determined that the optimum atmosphere quotient range for $O_2$ is 29 to 31 for cauliflower florets initially packaged with 800 milliliters of air in the void space per pound.

EXAMPLE 2

Using the data obtained in Example 1, we computed the optimum packaging for cauliflower packages required to contain three pounds of cauliflower using the oxygen atmosphere quotient range of 29 to 31 determined in Example 1 above. We adjusted the size of the package to maintain the oxygen atmosphere quotient within the range of 29 to 31.

For cauliflower-containing packages having an oxygen permeability of 550, as determined in accordance with example an area of 7.76 times 100 square inches, as determined in Example 1; and a package weight of three pounds, the permeant factor (G) is 1423 (4268/3).

To maintain the atmosphere quotient in the range of 29 to 31, and to maintain permeant factor at 1423, the respiration rate range had to be in the range 47 to 50 as computed by the formula R equals G divided by AQ, where R is 50 or 47, G is 1423, and AQ is 29 or 31.

Where the initial respiration rate fell outside the 47–50 range, we had to adjust the length of the packaging by adjusting the placement of the heat seal the package to maintain the desired permeant factor. For example, to attain an oxygen atmosphere quotient of 30 for cauliflower having a respiration rate of about 48 miligrams per kiligram-hour, with a packaged cauliflower weight of 3 pounds, package film oxygen permeability of 550, and a package width of 13 inches, the heat seal was made across the width of the package to produce a package length of about 30.2 inches. For a respiration rate of 40, the heat seal would have to be placed to produce a package length of 25.2 inches. For a respiration rate of 60, the heat seal would have to be placed to produce a package length of 37.8 inches.

For the package of cauliflower weighing 3 pounds, with cauliflower respiration rate of 48, where the package film oxygen permeability was 550, and the package width was 13 inches, we multiplied respiration rate by atmosphere quotient to determine permeant factor, then multiplied permeant factor by the weight of the perishable, and divided the product by the permeability (550) to determine the package area. We then determined package length from the formula: package film area (A) equals the number two (because this package was two-sided) multiplied by the length (1) and by the width (w) of the package, and divided by the number 100, or A=(2)(1)(w)/(100). In this case, the area was 7.85× 100 or 785 square inches, and the width was 13 inches. Therefore, the length, determined arithmetically, was 30.2 inches.

What is claimed is:

1. A sealed package comprising a sealed plastic film enclosure and at least one kind of respiring perishable produce inside said sealed enclosure, said sealed package transmitting oxygen and carbon dioxide at known or ascertainable rates, said sealed package having an atmosphere quotient value (QA) that is in a range including an optimum AQ value, said range defined by AQ values up to about 20% larger than, and up to about 20% smaller than said optimum AQ value, where said produce has a known or ascertainable respiration rate (R), where atmosphere quotient is equal to permeant factor (G) divided by said respiration rate (R), and where permeant factor (G) is equal to the area (A) of said sealed package multiplied by the permeability (P) of said sealed package to oxygen or carbon dioxide and divided by the total weight (W) of said produce in said sealed package, said optimum AQ value lying on a curve of empirically-determined AQ test values representing marketability of said produce, said curve being derived from testing at least one series of sealed test packages for said marketability by varying area (A) of said sealed packages in said series or by varying the total weight (W) of said produce in said sealed packages in said series, or by varying the permeability of said series of sealed packages to oxygen or carbon dioxide, or by varying two or more of said area, said total weight, and said permeability in said series of sealed packages, where each of said packages in each of said series has substantially the same initial gaseous atmosphere per unit weight of said produce, said curve including sufficient points to define said optimum AQ value and AQ values up to about 20% larger than and up to about 20% smaller than said optimum AQ value.

2. The package of claim 1 further comprising a desired initial internal void volume per unit weight of said at least one perishable produce.

3. The package of claim 2 wherein said permeability (P) of said package is to oxygen.

4. The package of claim 2 wherein said permeability (P) of said package is to carbon dioxide.

5. The package of claim 1 wherein said permeability (P) of said package is to oxygen.

6. The package of claim 1 wherein said permeability (P) of said package is to carbon dioxide.

7. The package of claim 1 wherein said sealed package comprises more than one kind of respiring perishable produce.

* * * * *